US011351688B2

(12) United States Patent
Han et al.

(10) Patent No.: US 11,351,688 B2
(45) **Date of Patent: *Jun. 7, 2022**

(54) RAZOR

(71) Applicant: DORCO CO., LTD., Seoul (KR)

(72) Inventors: Sang Ho Han, Seoul (KR); Hyo Sun Ahn, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/187,232

(22) Filed: Feb. 26, 2021

(65) Prior Publication Data

US 2021/0178618 A1 Jun. 17, 2021

Related U.S. Application Data

(63) Continuation of application No. 16/313,092, filed as application No. PCT/KR2016/008487 on Aug. 2, 2016, now Pat. No. 10,960,562.

(30) Foreign Application Priority Data

Jun. 24, 2016 (KR) ..... 10-2016-0079376

(51) Int. Cl.
*B26B 21/52* (2006.01)
*B26B 21/40* (2006.01)
(Continued)

(52) U.S. Cl.
CPC ..... *B26B 21/521* (2013.01); *B26B 21/08* (2013.01); *B26B 21/20* (2013.01); *B26B 21/40* (2013.01);
(Continued)

(58) Field of Classification Search
CPC ..... B26B 21/521; B26B 21/08; B26B 21/20; B26B 21/40; B26B 21/4018; B26B 21/52; B26B 21/222; B26B 21/443; B26B 21/522
(Continued)

(56) References Cited

U.S. PATENT DOCUMENTS 3,768,162 A 10/1973 Perry
4,094,063 A 6/1978 Trotta
(Continued)

FOREIGN PATENT DOCUMENTS

JP 09285664 11/1997
KR 100179231 4/1999
(Continued)

OTHER PUBLICATIONS

European Patent Office Application Serial No. 16906381.5, Search Report dated Jan. 17, 2020, 6 pages.
(Continued)

*Primary Examiner* — Omar Flores Sanchez
(74) *Attorney, Agent, or Firm* — Lee, Hong, Degerman, Kang & Waimey PC

(57) ABSTRACT

The present disclosure relates to a razor having a coupling structure of a razor blade cartridge and a handle, including a razor blade cartridge including at least one razor blade, a blade housing in which the at least one razor blade is accommodated, a cartridge frame coupled to the blade housing and configured to secure the at least one razor blade to the blade housing; and a handle coupled to a rear of the razor blade cartridge, wherein a first hook is formed at a rear of the blade housing; a second hook is formed at a rear of the cartridge frame; and the handle is configured to be engaged with the first hook and the second hook such that the handle is coupled to the rear of the razor blade cartridge.

8 Claims, 6 Drawing Sheets

(51) Int. Cl.

| | |
|---|---|
| ***B26B 21/20*** | (2006.01) |
| ***B26B 21/08*** | (2006.01) |
| *B26B 21/22* | (2006.01) |
| *B26B 21/44* | (2006.01) |

(52) U.S. Cl.
CPC ..... *B26B 21/4018* (2013.01); *B26B 21/52* (2013.01); *B26B 21/222* (2013.01); *B26B 21/443* (2013.01); *B26B 21/522* (2013.01)

(58) Field of Classification Search
USPC ..... 30/526
See application file for complete search history.

(56) References Cited

U.S. PATENT DOCUMENTS

| | | | |
|---|---|---|---|
| 4,308,663 | A | 1/1982 | Ciaffone |
| 4,392,303 | A | 7/1983 | Ciaffone |
| 4,428,116 | A | 1/1984 | Chen et al. |
| 4,475,286 | A | 10/1984 | Saito |
| 4,573,266 | A | 3/1986 | Jacobson |
| 4,692,986 | A | 9/1987 | Motta et al. |
| 5,236,439 | A | 8/1993 | Kozikowski |
| 5,669,139 | A | 9/1997 | Oldroyd et al. |
| 5,687,485 | A | 11/1997 | Shurtleff et al. |
| 5,761,814 | A | 6/1998 | Anderson et al. |
| 5,956,848 | A | 9/1999 | Tseng et al. |
| 5,956,851 | A | 9/1999 | Apprille et al. |
| 6,041,926 | A | 3/2000 | Petricca et al. |
| 6,052,903 | A | 4/2000 | Metcalf et al. |
| 6,185,822 | B1 | 2/2001 | Tseng et al. |
| 6,212,777 | B1 | 4/2001 | Gilder et al. |
| 6,311,400 | B1 | 11/2001 | Hawes et al. |
| 6,442,839 | B1 | 9/2002 | Tseng et al. |
| 6,516,518 | B1 | 2/2003 | Garraway et al. |
| 6,612,040 | B2 | 9/2003 | Gilder |
| 6,684,513 | B1 | 2/2004 | Clipstone et al. |
| 6,880,253 | B1 | 4/2005 | Gyllerstrom |
| 7,975,389 | B2 | 7/2011 | Bozikis et al. |
| 8,671,577 | B2 | 3/2014 | Brown |
| 8,745,882 | B2 | 6/2014 | Murgida et al. |
| 8,745,883 | B2 | 6/2014 | Murgida et al. |
| 9,623,575 | B2 | 4/2017 | Griffin et al. |
| 9,630,331 | B2 | 4/2017 | Griffin et al. |
| 9,694,503 | B2 | 7/2017 | Papadopoulos et al. |
| 9,757,870 | B2 | 9/2017 | Giannopoulos et al. |
| 9,844,887 | B2 | 12/2017 | Griffin et al. |
| 10,183,407 | B2 | 1/2019 | Griffin et al. |
| 10,272,580 | B2 | 4/2019 | Griffin et al. |
| 10,328,587 | B2 | 6/2019 | Griffin et al. |
| 10,391,654 | B2 | 8/2019 | Griffin et al. |
| 2004/0055159 | A1 | 3/2004 | Khomari |
| 2006/0080838 | A1 | 4/2006 | Johnson et al. |
| 2007/0006463 | A1 | 1/2007 | Pennella |
| 2007/0245564 | A1 | 10/2007 | Yiu |
| 2011/0232101 | A1 | 9/2011 | Park et al. |
| 2012/0144675 | A1 | 6/2012 | Keene et al. |
| 2013/0291390 | A1 | 11/2013 | Gajria et al. |
| 2014/0083265 | A1 | 3/2014 | Provost et al. |
| 2015/0128424 | A1 | 5/2015 | Witkus et al. |
| 2016/0089800 | A1 | 3/2016 | Coresh |
| 2016/0354939 | A1 | 12/2016 | Hill et al. |
| 2017/0008183 | A1 | 1/2017 | Bridges et al. |
| 2017/0129116 | A1 | 5/2017 | Gratsias et al. |
| 2018/0257249 | A1 | 9/2018 | Wattam et al. |
| 2018/0297223 | A1 | 10/2018 | Hodgson |
| 2019/0084169 | A1 | 3/2019 | Bonk et al. |
| 2019/0224872 | A1 | 7/2019 | Han et al. |
| 2019/0232511 | A1 | 8/2019 | Griffin et al. |

FOREIGN PATENT DOCUMENTS

| | | |
|---|---|---|
| KR | 1020100091622 | 8/2010 |
| KR | 1020110057200 | 5/2011 |
| KR | 101424319 | 8/2014 |
| KR | 1020150095934 | 8/2015 |
| WO | 00/09299 | 2/2000 |
| WO | 2010039749 | 4/2010 |
| WO | 2014094905 | 6/2014 |
| WO | 2019046097 | 3/2019 |

OTHER PUBLICATIONS

U.S. Appl. No. 16/313,092, Notice of Allowance dated Nov. 27, 2020, pages.

U.S. Appl. No. 16/313,092, Office Action dated Nov. 19, 2019, 6 pages.

PCT International Application No. PCT/KR2016/008487, Written Opinion of the International Searching Authority dated Mar. 6, 2017, 11 pages.

Korean Intellectual Property Office Application No. 10-2016-0079376, Prioritized Search Report dated Jun. 24, 2016, 8 pages.

Korean Intellectual Property Office Application No. 10-2016-0079376, Office Action dated Jul. 19, 2016, 34 pages.

Korean Intellectual Property Office Application No. 10-2016-0079376, Notice of Allowance dated Jan. 24, 2017, 2 pages.

RAZOR

CROSS-REFERENCE TO RELATED APPLICATIONS

This application is a continuation of U.S. patent application Ser. No. 16/313,092, filed on Dec. 24, 2018, which is the National Stage filing under 35 U.S.C. 371 of International Application No. PCT/KR2016/008487, filed on Aug. 2, 20216, which claims the benefit of earlier filing date and right of priority to Korean Patent Application No. 10-2016-0079376, filed on Jun. 24, 2016, the contents of which are all hereby incorporated all by reference herein in their entirety.

BACKGROUND

Generally, a razor cartridge has a razor blade seated thereon and is provided together with a guard or the like so that the razor blade safely comes into contact with the skin. The cartridge razor includes a razor blade cartridge configured to suitably determine a degree to which the razor blade protrudes, and a handle coupled to the razor blade cartridge and provided to be hand-held and controlled by a user.

For the combination of the razor blade cartridge and the handle, a coupling portion at the rear of the razor blade cartridge is generally configured to include hooks, which are engaged with locking portions formed at both side surfaces of the end of the handle. Alternatively, the rear surface of the cartridge and the end of the handle are generally fixed to each other using thermal compression or adhesive.

However, the above-mentioned fixing structure of the handle cannot firmly hold the razor handle and the razor blade cartridge when the razor is dropped on the floor during use of the razor, or strongly shaken in order to wash the razor. This is because, assuming that the cross-section of the razor handle is a square with four edges, even though two edges are fixed by a holder of the razor blade cartridge, the other two edges are not fixed.

Further, the razor is mostly sold with a cap covering a razor blade portion of the razor blade cartridge in order to prevent inadvertent cutting by the razor blade during transport or storage before use for shaving and to protect the razor blade from external factors. The cap is provided primarily to cover all or only part of the razor blade exposing surface of the razor blade cartridge. The operation of covering the razor with the cap can be performed safely only by pressing the cap to correspond to the razor blade exposing surface. However, in order to remove the cap, a force should be exerted in a direction of separating the razor blade cartridge from the razor handle. In this case, since the cap is fixed to the razor blade cartridge, when detaching the cap from the razor blade cartridge, the razor blade cartridge may also be detached from the razor handle, which is problematic.

One aspect of the present disclosure provides a coupling structure of a razor blade cartridge and a handle, which is capable of stably holding the handle.

It should be noted that objects of the present disclosure are not limited to the above-mentioned objects, and other unmentioned objects of the present disclosure will be clearly understood by those skilled in the art from the following descriptions.

SUMMARY

To achieve the above objects, a razor according to an embodiment of the present disclosure includes a razor blade cartridge including at least one razor blade, a blade housing in which the at least one razor blade is accommodated, a cartridge frame coupled to the blade housing and configured to secure the at least one razor blade to the blade housing; and a handle coupled to a rear of the razor blade cartridge, wherein a first hook is formed at a rear of the blade housing; a second hook is formed at a rear of the cartridge frame; and the handle is configured to be engaged with the first hook and the second hook such that the handle is coupled to the rear of the razor blade cartridge.

Further, the first hook includes two side hooks each aligned perpendicular to a direction in which the at least one razor blade is accommodated, and the second hook is aligned parallel to the direction in which the at least one razor blade is accommodated.

In some embodiments, the two side hooks are aligned parallel to each other and configured to engage with side surfaces of the handle, and the second hook is disposed at an upper end of the rear of the cartridge frame.

In some embodiments, the first hook and the second hook are each formed to be tapered in a front to rear direction.

In some embodiments, the handle includes a first locking portion corresponding to the first hook and a second locking portion corresponding to the second hook.

In some embodiments, the first locking portion and the second locking portion are each formed to be tapered in a rear to front direction.

In some embodiments, the first locking portion comprises an upwardly extending portion; and the first hook is configured to include a corresponding member configured to engage with the upwardly extending portion.

In some embodiments, the handle is shaped to comprise a through-hole which extends along at least a portion of a profile of the handle; and the through-hole includes a first open area facing toward the rear surface of the razor blade cartridge and a second open area opposite the first open area.

In some embodiments, the blade housing includes a blade housing guard portion which protrudes past a front surface of the cartridge frame.

In some embodiments, a side surface of the blade housing is externally exposed.

According to embodiments of the present disclosure, there are at least the following advantageous effects.

By using a razor blade cartridge reinforced with handle coupling hooks as compared to a conventional razor, it is possible to prevent the cartridge from being detached from a razor handle when an external force is applied thereto, for example, when removing a cap.

By disposing the handle coupling hooks on the rear surfaces of a cartridge frame and a blade housing, respectively, it is possible to prevent the blade housing and the cartridge frame from being separated from each other when an impact occurs on a razor.

Advantageous effects according to the present disclosure are not limited to those mentioned above, and various other advantageous effects are included herein. Still other unmentioned effects should be clearly understood by those of ordinary skill in the art from the claims below.

DETAILED DESCRIPTION

Figure 1:
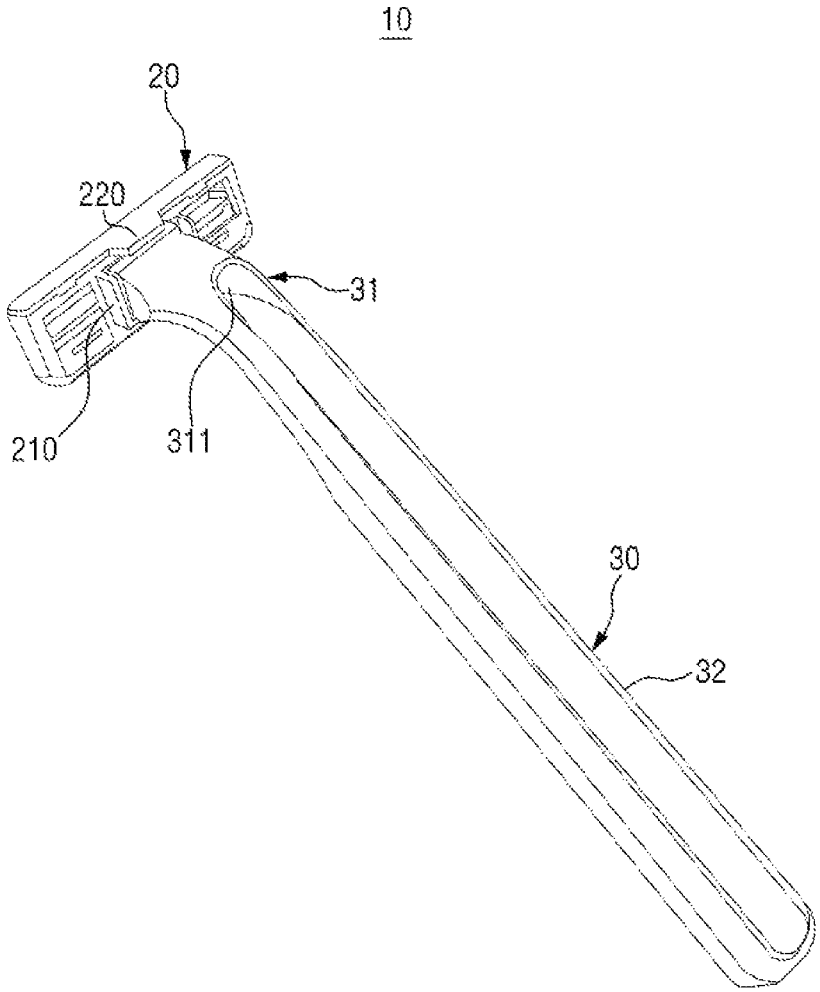
FIG. 1 is a perspective view illustrating a form in which a razor handle and a cartridge are coupled according to an embodiment of the present disclosure.

Advantages and features of the present disclosure and a method of achieving the same should become clear with embodiments described in detail below with reference to the accompanying drawings. However, the present disclosure is not limited to the embodiments disclosed below and may be realized in various other forms. The present embodiments make the disclosure complete and are provided to completely inform one of ordinary skill in the art to which the present disclosure pertains of the scope of the disclosure. The present disclosure is defined only by the scope of the claims. Like reference numerals refer to like elements throughout.

Unless otherwise defined, all terms including technical and scientific terms used herein have the same meaning as commonly understood by one of ordinary skill in the art to which the present disclosure pertains. Terms, such as those defined in commonly used dictionaries, are not to be construed in an idealized or overly formal sense unless expressly so defined herein.

Terms used herein are for describing the embodiments and are not intended to limit the present disclosure. In the present specification, a singular expression includes a plural expression unless the context clearly indicates otherwise. "Comprises" and/or "comprising" used herein do not preclude the existence or the possibility of adding one or more elements other than those mentioned.

In addition, embodiments herein will be described with reference to cross-sectional views and/or schematic views, which are ideal exemplary views of the present disclosure. Therefore, the form of an exemplary view may be deformed due to a manufacturing technique and/or an allowable error. In addition, in each drawing of the present disclosure, each element may have been somewhat enlarged or reduced in consideration of convenience of description. Like reference numerals refer to like elements throughout, and "and/or" includes each mentioned item and all of one or more combinations of the mentioned items.

Spatially relative terms are intended to encompass different orientations of elements in use or operation in addition to the orientation depicted in the drawings. An element may be oriented in a different direction, and accordingly, spatially relative terms may be interpreted according to orientations.

Hereinafter, configurations of exemplary embodiments of the present disclosure will be described in detail with reference to the accompanying drawings.

FIG. 1 is a perspective view illustrating a form in which a razor handle 30 and a razor blade cartridge 20 are coupled according to an embodiment of the present disclosure.

Referring to FIG. 1, a razor according to an embodiment of the present disclosure includes the handle 30 and the razor blade cartridge 20. The handle 30 is coupled to the razor blade cartridge 20 using a hook coupling method. This will be described in detail below.

The handle 30 of the razor includes a handle portion 32 which is in the form of a long extending bar so as to be held and used for the purpose of manipulating the razor by a user, and one end which is coupled to the razor blade cartridge 20 and has a through-hole 31 formed therein.

Since the handle portion 32 has to provide a suitable grip feeling to the user, regular concave and convex patterns are formed at a side surface of the handle portion 32 in a direction which is perpendicular to a longitudinal direction of the razor such that a surface area in contact with the user's hand is increased and a frictional force is increased. In this way, the razor is prevented from easily falling out of the user's hand even in a shaving environment in which water and a large amount of a lubricating liquid such as shaving foam and shaving gel are used. Since a lower surface of the handle portion 32 is irrelevant to the provision of a grip feeling, the lower surface may be configured in the form of a hollow cavity. Therefore, simplification of a manufacturing process and saving of materials can be achieved.

One end of the handle 30 is coupled to the razor blade cartridge 20. The handle 30 may be formed in a straight shape and have the cartridge disposed at the one end thereof to be perpendicular to a longitudinal direction of the handle 30. However, in this case, since there is an inconvenience in that the user has to perform shaving by moving his or her hand in a horizontal direction, the one end of the handle 30 may be configured in the form that is bent at a predetermined angle from an advancing direction of the handle portion 32 so that a cutting surface of the razor blade cartridge 20 naturally comes into contact with the skin to be shaved when the user naturally holds the razor.

The through-hole 31 is formed along a profile of the handle 30 at the one end of the handle 30. The through-hole 31 may extend along at least a portion of the profile of the handle 30, and an open surface is present at each of an upper surface and a lower surface of the handle 30 and passes through the handle 30. A detailed configuration of the through-hole 31 will be described below with reference to FIGS. 3 and 4.

The handle 30 of the razor according to an embodiment of the present disclosure may be formed such that a transverse cross-sectional area of the handle 30 progressively widens from the handle portion 32 toward the razor blade cartridge 20. Therefore, user convenience can be improved by configuring the handle portion 32 of the handle 30 to have a transverse cross-sectional area that is suitable for the handle portion 32 to be used while being gripped by the user's hand and by configuring the one end of the handle 30 to have a transverse cross-sectional area that is suitable for the one end of the handle 30 to be coupled to the razor blade cartridge 20.

Figure 2:
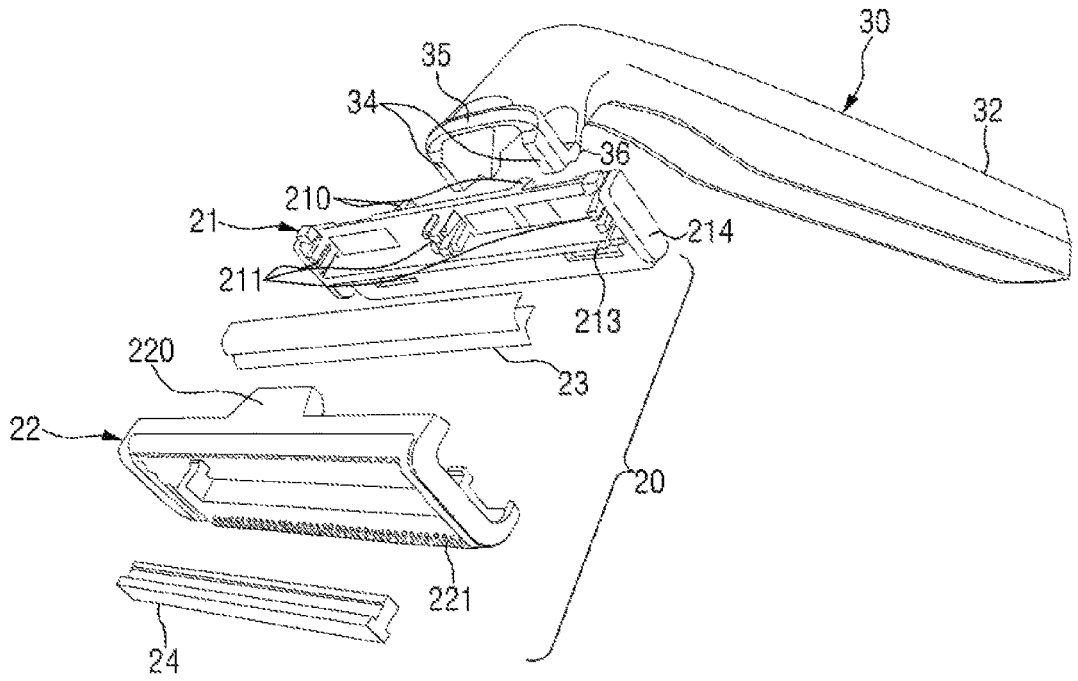
FIG. 2 is an exploded view of the razor handle and the cartridge according to an embodiment of the present disclosure.

FIG. 2 is an exploded view of the razor handle 30 and the razor blade cartridge 20 according to an embodiment of the present disclosure.

Referring to FIG. 2, the razor blade cartridge 20 includes a blade housing 21, at least one razor blade 23, and a cartridge frame 22 and may further include a guard portion.

The blade housing 21 may accommodate the at least one razor blade 23, and the razor blade 23 is inserted into a seating portion 211 disposed at a front portion of the blade housing 21. A lower end of the razor blade 23 is inserted into the seating portion 211 such that the seating portion 211 fixes the razor blade 23 to the blade housing 21. It is not necessary for the seating portion 211 to be formed throughout the entire blade housing 21, and it is sufficient as long as the seating portion 211 is able to fix the razor blade 23 to the extent that the razor blade 23 is fixed without being detached from the blade housing 21 and is able to withstand a force applied during cutting such that shaving is smoothly performed. Therefore, as illustrated in FIG. 2, the seating portion 211 may be disposed at both ends and the center of the blade housing 21 in a long direction of the blade housing 21. The arrangement of the seating portion 211 is not limited thereto, and various embodiments such as an embodiment in which the seating portion 211 is disposed at each of four positions at equal intervals in the long direction of the blade housing 21 may be possible. The arrangement of the seating portion 211 which is different from the above embodiment will be described below in description of another embodiment of the present disclosure with reference to FIG. 6.

Two razor blades 23 and two seating portions 211 are respectively adjacently disposed in a short direction of the blade housing 21 in the above embodiment of the present disclosure, but the number of razor blades 23 and seating portions 211 is not limited thereto. The number of razor blades 23 may be 1 or greater, and the number of seating portions 211 is determined corresponding to the maximum number of razor blades 23 desired to be coupled.

A portion of the blade housing 21 may be configured to protrude forward below the seating portion 211. This portion may be configured to further protrude forward past a front surface of the cartridge frame 22 when the blade housing 21 is coupled to the cartridge frame 22 and may serve as a blade housing guard 213. The blade housing guard 213 may serve as a protrusion with which or to which the blade housing 21 additionally comes into contact or is locked in order to be more firmly coupled to the cartridge frame 22, or may also serve as a guard that comes into contact with the skin first during shaving before the razor blade 23 and determines a cutting surface. Unlike a conventional situation in which a guard portion is formed in the separately-assembled cartridge frame 22 or a separate guard component is coupled and installed therein, the guard is disposed in the blade housing 21, which is the same component as the seating portion 211 on which the razor blade 23 is seated. Therefore, in comparison to a conventional razor in which it is difficult to form a desired height difference between the razor blade 23 and the guard and tolerance occurs during manufacture and assembly, it is easy to adjust a height difference between the razor blade 23 and the guard and thus advantageous in forming a desired cutting surface.

Side surfaces 214 of the blade housing are surfaces disposed at sides of the blade housing 21. The side surfaces 214 may be configured as two surfaces parallel to each other so that the user is able to easily grip the razor blade cartridge 20, without the razor blade cartridge 20 being slipped from the user's hand, when the user couples or separates the razor blade cartridge 20 and the handle 30 to or from each other. Alternatively, the side surfaces 214 may be configured to be exposed or protrude sideward even after the side surfaces 214 are coupled to the cartridge frame 22.

To cover the blade housing 21 and allow the razor blade 23 to be exposed forward, the cartridge frame 22 is formed such that a central portion excluding an outer periphery is open.

The cartridge frame 22 is coupled from a front surface of the blade housing 21. In the coupling process, both side ends of the front surface of the cartridge frame 22 are coupled to press the razor blade 23, which is inserted into the blade housing 21 and the seating portion 211, toward a rear surface of the razor blade cartridge 20. Therefore, a lower portion of the razor blade 23 being inserted into the seating portion 211 may not alone firmly secure the razor blade 23, but by the cartridge frame 22 being firmly coupled and fixed to the blade housing 21, the razor blade 23 may also be firmly secured. The shape of the inner surfaces of both side ends of the front surface of the cartridge frame 22 and the shape of side ends of the front surface of the blade housing 21 are formed to correspond to each other so that the blade housing 21 and the cartridge frame 22 may be easily coupled.

A frame guard 221 may be formed at a lower end of the front surface of the cartridge frame 22 and serve to determine a cutting surface, or may be formed as a comb guard and serve to brush and align facial hair desired to be cut. However, the form and position of the frame guard 221 are not limited thereto. The frame guard 221 may also be disposed at an upper end of the front surface of the cartridge frame 22 or may have forms other than the comb guard form.

A lubricating band 24 may be disposed at a lower end of a front portion of the cartridge frame 22 and provide lubrication during shaving. However, this is merely one embodiment, and the lubricating band 24 may also be disposed at an upper end of the front portion of the cartridge frame 22.

For the handle 30 to be coupled to the rear surface of the razor blade cartridge 20, the razor blade cartridge 20 of the razor according to an embodiment of the present disclosure includes a first hook 210 formed at the blade housing 21, and a second hook 220 is disposed at the cartridge frame 22 and made to correspond to the handle 30.

The first hook 210 is a hook disposed at a rear surface of the blade housing 21. The first hook 210 may be disposed perpendicular to the direction in which the razor blade 23 is arranged, and may protrude rearward from the rear surface of the razor blade cartridge 20 to be coupled to a side surface of the one end of the handle 30. The first hook 210 may include two parallel side hooks having a distance therebetween which is similar to a size of the one end of the handle 30. Therefore, the side hooks may hold both side surfaces of the one end of the handle 30 toward the inside of the handle 30 and may fix the handle 30 to the razor blade cartridge 20.

The second hook 220 is a hook disposed at a rear surface of the cartridge frame 22. The second hook 220 may be disposed at an upper end of the rear surface of the cartridge frame 22, may extend to be parallel to the direction in which the razor blade 23 is arranged, and may protrude rearward to be coupled to an upper surface of the one end of the handle 30.

The first hook 210 and the second hook 220 have been described as members which protrude to fix a surface of the one end of the handle 30, but the meaning of the expression "hook" is not limited thereto. A structure other than the structure described herein, such as the form of a groove capable of accommodating a protrusion disposed at one end of the handle 30, may be used for the hooks as long as the structure is able to fix one end of the handle 30 and one end of the razor blade cartridge 20 to each other by bring the two in contact and engaging the two, and the structure is able to correspond to a structure of locking portions disposed at the handle 30.

A first locking portion 34 and a second locking portion 35 which correspond to the first hook 210 and the second hook 220, respectively, are formed at the one end of the handle 30.

The first locking portion 34 is disposed at a side surface of a first open end 310, which is one side opening of the through-hole 31 at the one end of the handle 30, and protrudes toward the side of the handle 30. A length of the first locking portion 34 is formed such that the first locking portion 34 corresponds to the first hook 210 disposed at the rear surface of the blade housing 21. When the first hook 210 includes two side hooks, the number of first locking portions 34 correspond to the number of side hooks, and an interval between the first locking portions 34 correspond to an interval between the side hooks.

The second locking portion 35 is disposed at an upper surface of the first open end 310, which is the one side opening of the through-hole 31 at the one end of the handle 30, and protrudes toward the top of the handle 30. The form and position of the second locking portion 35 are determined such that the second locking portion 35 corresponds to the second hook 220 during coupling.

The above-mentioned structure is merely one embodiment, and coupling structures other than the hooks may be used as long as the structures are evident to those of ordinary skill in the art. The position of the second hook 220 may also be changed to a lower end of the rear surface of the cartridge frame 22, and the position of the second locking portion 35 may be changed corresponding thereto.

A process in which the handle 30 and the razor blade cartridge 20, which are separate from each other, are coupled and an appearance of the through-hole 31 will be described with reference to FIGS. 1, 3, and 4.

Figure 3:
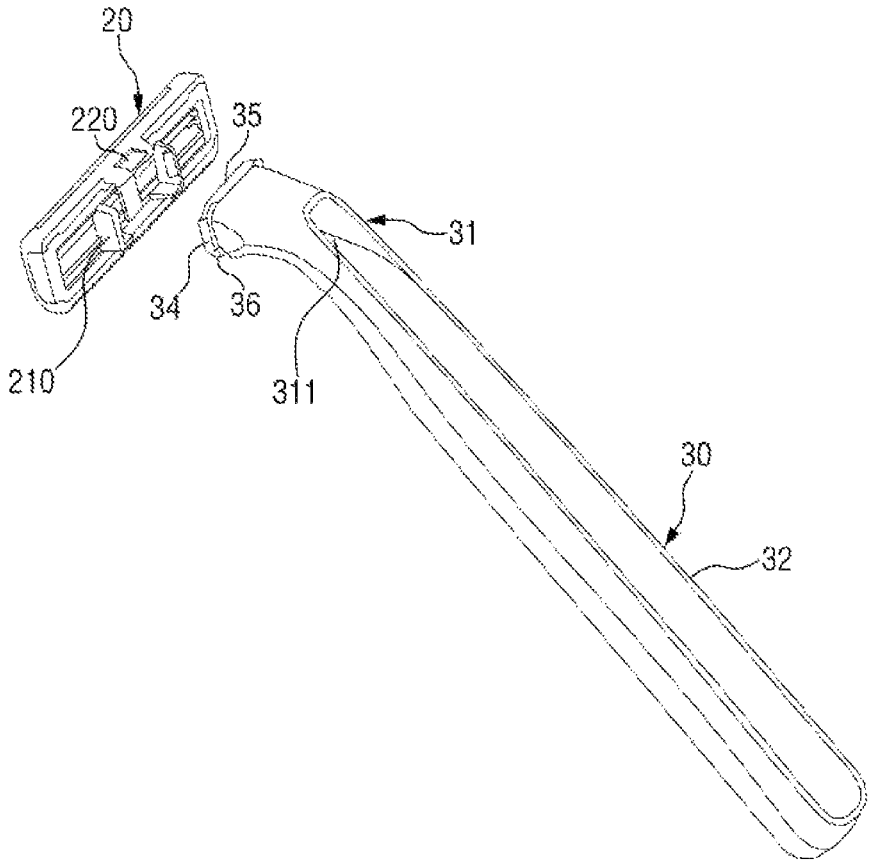
FIG. 3 is a perspective view illustrating a form in which the razor handle and the cartridge are separated according to an embodiment of the present disclosure.
Figure 4:
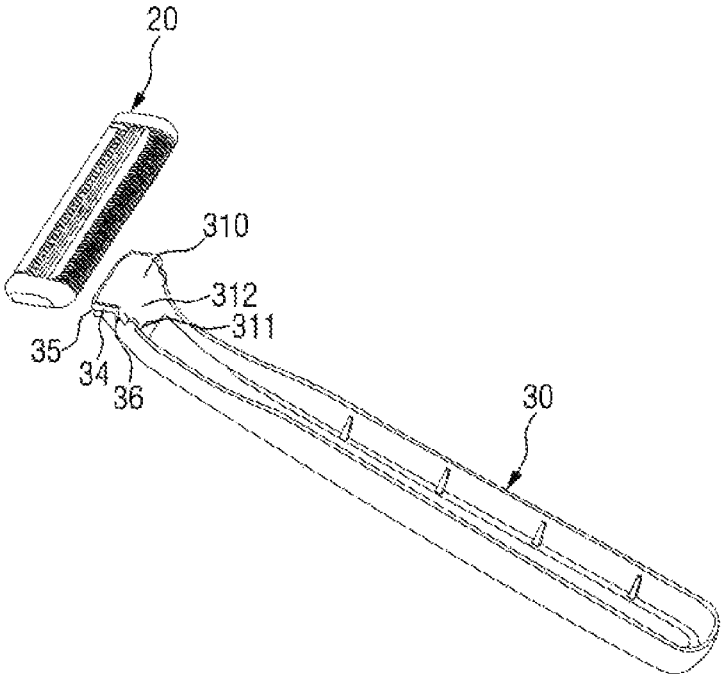
FIG. 4 is a perspective view illustrating the form, in which the razor handle and the cartridge are separated according to the embodiment of the present disclosure, in a direction opposite from FIG. 2.

FIG. 3 is a perspective view illustrating a form in which the razor handle 30 and the razor blade cartridge 20 are separated according to an embodiment of the present disclosure, and FIG. 4 is a perspective view illustrating the form, in which the razor handle 30 and the razor blade cartridge 20 are separated according to the embodiment of the present disclosure, in a direction opposite from FIG. 2.

Referring to FIGS. 1, 3, and 4, the first hook 210 corresponds to the first locking portion 34 and is engaged therewith during coupling while the second hook 220 corresponds to the second locking portion 35 and is engaged therewith during coupling.

When the rear surface of the razor blade cartridge 20 and the one end of the handle 30 are brought into contact and then an external force is applied from each one toward the other, the first locking portion 34 is pushed into a space between the first hook 210 and the rear surface of the blade housing 21 and is locked to the first hook 210 and fixed so as not to be detached in a long direction of the razor blade cartridge 20 and a direction in which the front and rear surfaces of the razor blade cartridge 20 face each other. Simultaneously, the second locking portion 35 is pushed into a space between the second hook 220 and the rear surface of the cartridge frame 22 and is locked to the second hook 220 and fixed so as not to be detached in the short direction of the razor blade cartridge 20 and the direction in which the front and rear surfaces of the razor blade cartridge 20 face each other.

Therefore, due to the coupling between the first hook 210 and the first locking portion 34, the handle 30 is restricted from being detached in the long direction of the razor blade cartridge 20; due to the coupling between the second hook 220 and the second locking portion 35, the handle 30 is restricted from being detached in the short direction of the razor blade cartridge 20; and due to the first hook 210 and the second hook 220 being coupled to the first locking portion 34 and the second locking portion 35, respectively, the handle 30 is prevented from being detached in the direction in which the front and rear surfaces of the razor blade cartridge 20 face each other. In this way, when an external force is applied due to attempting to detach a cap in the short direction of the razor blade cartridge 20 or performing shaving in the short direction of the razor blade cartridge 20, the risk that the razor blade cartridge 20 might be detached from the handle 30 may be eliminated.

In addition, since the first hook 210 disposed at the blade housing 21 is not the only one coupled to the handle 30, and the second hook 220 disposed at the cartridge frame 22 is involved in the coupling between the razor blade cartridge 20 and the handle 30, the blade housing 21 and the cartridge frame 22 are more firmly fixed to each other due to the coupling between the razor blade cartridge 20 and the handle 30.

For smooth coupling between the one end of the handle 30 and the hooks of the rear surface of the razor blade cartridge 20, the first hook 210 and the second hook 220 may be formed to be tapered in a direction from the front surface to the rear surface of the razor blade cartridge 20. Corresponding to this, the first locking portion 34 and the second locking portion 35 of the one end of the handle 30 may also be formed to be tapered in a direction from the handle portion 32 of the handle 30 toward the razor blade cartridge 20. Therefore, when the hooks or locking portions are formed to be tapered and form an inclined surface, when the locking portions are inserted into the rear surface of the razor blade cartridge 20, the locking portions may easily enter the rear surface and be coupled thereto along the inclined surface with a small force.

Referring to FIGS. 3 and 4, the first open area 310, a second open area 311, and a third open area 312, which are one-side openings of the through-hole 31 of the razor handle 30 of an embodiment of the present disclosure, may be seen.

The first open area 310 is formed at the one end of the handle 30 so as to face the razor blade cartridge 20, and the second open area 311 is formed at the upper surface of the handle 30. Therefore, the through-hole 31 has a structure that connects the first open area 310 and the second open area 311 and passes through the handle 30, and the through-hole 31 extends along at least a portion of the profile of the handle 30.

The second open area 311 is disposed opposite the first open area 310. Here, being disposed opposite means that a path formed through the handle 30 from the first open area 310 to the second open area 311 becomes the through-hole 31 and thus the first open area 310 and the second open area 311 become one opening and the other opening, which is at the opposite side of the one opening.

Since the through-hole 31 has a structure in which the both openings are formed at the one end and the upper surface of the handle 30, when a liquid such as water is introduced through one open area, the liquid is discharged through the other open area. Therefore, when washing water is injected through the second open area 311 using such a structure, the washing water may be discharged through the first open area 310, which is adjacent to the rear surface of the razor blade cartridge 20, the washing water may be supplied to the razor blade cartridge 20, and washing may be performed. Particularly, since a central portion of the razor blade cartridge 20 is not smoothly washed using a general method, the central portion may be easily washed using the above-described method. Such a characteristic may be combined with the feature of the handle 30 of the embodiment of the present disclosure in that the transverse cross-sectional area of the handle 30 progressively widens from the handle portion 32 of the handle 30 toward the first open area 310 facing the razor blade cartridge 20, and the combination may further improve the washing efficiency.

The through-hole 31 may further include the third open area 312 which is adjacent to the first open area 310 and is open in a downward direction when the razor is held by a user. Therefore, when washing water is injected into the second open area 311, while the washing water is supplied to the razor blade cartridge 20 through the first open area 310, a portion of the washing water may also be supplied to the third open area 312 so that shaving debris discharged from the razor blade cartridge 20 may be discharged by washing using the washing water.

However, a washing method is not limited to that described above in which washing water is injected into the second open area 311. A washing method in which washing water is injected through the front surface of the razor blade cartridge 20 and the washing water and shaving debris are discharged to the first open area 310 and then subsequently discharged to the second open area 311 and the third open area 312, a washing method in which washing water is injected into the third open area 312 and the washing water is supplied to the rear surface of the razor blade cartridge 20 through the first open area 310 such that shaving debris is discharged to the front surface of the razor blade cartridge 20, or the like may be selected by the user.

Figure 5:
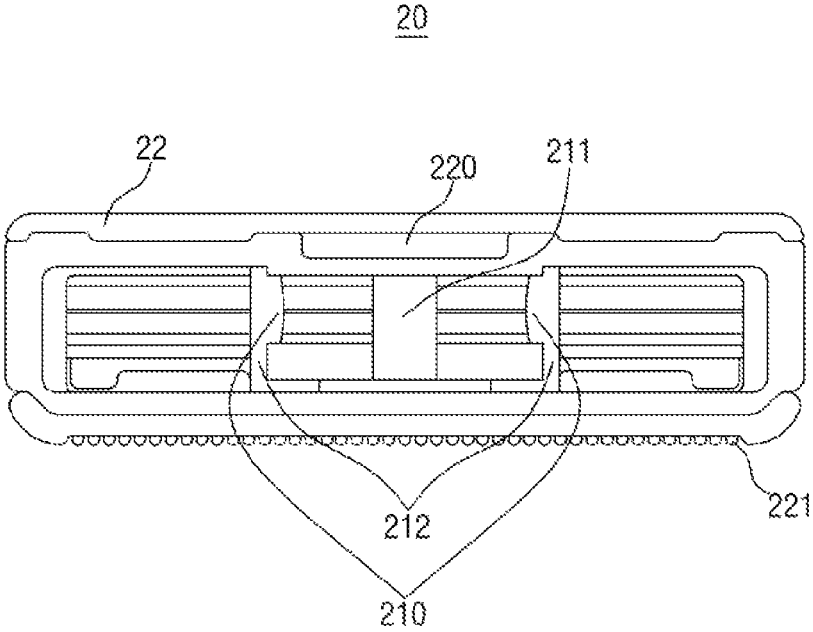
FIG. 5 is a rear view of a cartridge according to an embodiment of the present disclosure.

FIG. 5 is a rear view of the razor blade cartridge 20 according to an embodiment of the present disclosure.

Referring to FIG. 5, the first hook 210 may not be formed across the entire blade housing 21 in the short direction of the blade housing 21, and a hook groove 212 may be formed at a lower end of the first hook 210. When the razor blade cartridge 20 and the handle 30 are coupled, a locking extension portion 36 that may be seen in the handle 30 of FIG. 2 is disposed in the hook groove 212. Since the locking extension portion 36 is disposed adjacent to the first locking portion 34 and extends along the profile of the handle 30, the locking extension portion 36 is also locked to the first hook 210 in the short direction of the razor blade cartridge 20. Therefore, together with the second locking portion 35, the locking extension portion 36 serves to prevent the handle 30 from being detached in the short direction of the razor blade cartridge 20.

Figure 6:
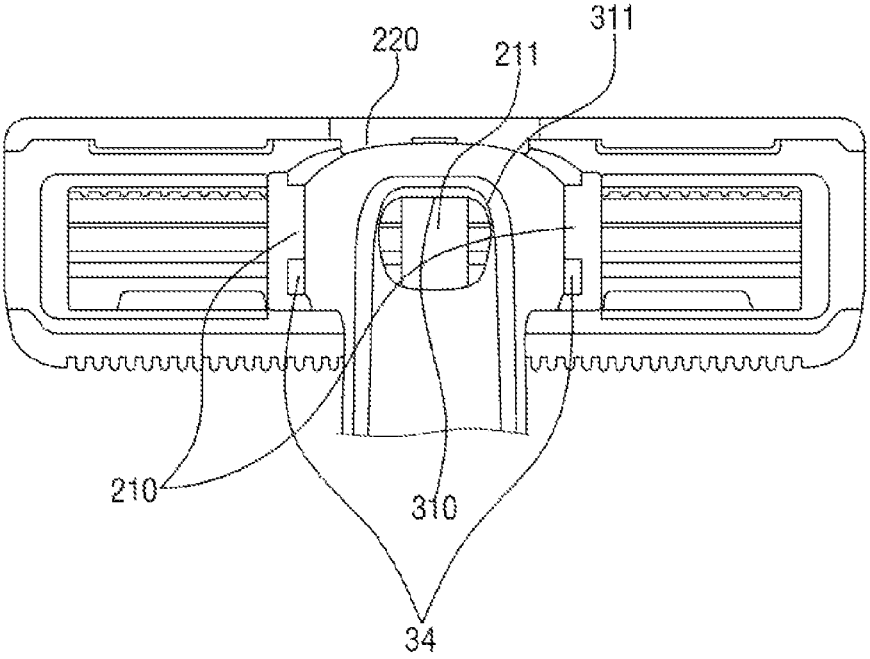
FIG. 6 is a rear view of a razor according to an embodiment of the present disclosure.

FIG. 6 is a rear view of a razor according to an embodiment of the present disclosure.

Referring to FIG. 6, it can be seen that the rear surface of the razor blade cartridge 20 can be observed through the through-hole 31 when the handle 30 is coupled to the rear surface of the razor blade cartridge 20. Therefore, when washing water is injected through the second open area 311 which is disposed at a rear portion of the through-hole 31, the washing water is supplied through the first open area 310 which is disposed at a front portion of the through-hole 31 and is adjacent to the rear surface of the razor blade cartridge 20, and the razor 10 may be washed from the rear surface.

Meanwhile, as can be seen through the through-hole 31 from the rear of the razor 10, the seating portion 211 may be observed through the through-hole 31. Therefore, the seating portion 211 may block a direct supply of washing water to the razor blade 23 seated on the blade housing 21, and thus washing of a central portion of the razor blade 23 may be somewhat insufficient.

Figure 7:
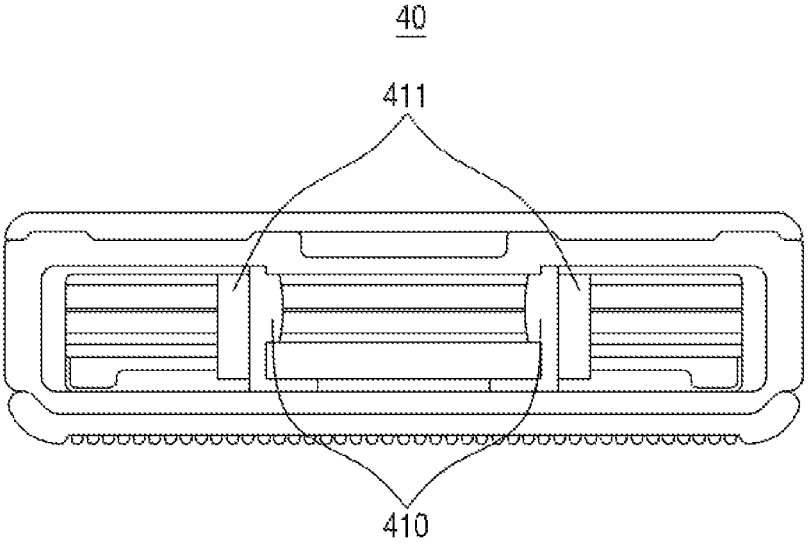
FIG. 7 is a rear view of a cartridge according to another embodiment of the present disclosure.

FIG. 7 is a rear view of a razor blade cartridge 40 according to another embodiment of the present disclosure.

Therefore, referring to FIG. 7, in order to solve the above-described problem in that washing may be insufficient, a seating portion 411 may be disposed at a position corresponding to a first hook 410 instead of being disposed at the center of the razor blade cartridge 40 such that a central portion of the razor blade cartridge 40 is exposed.

Figure 8:
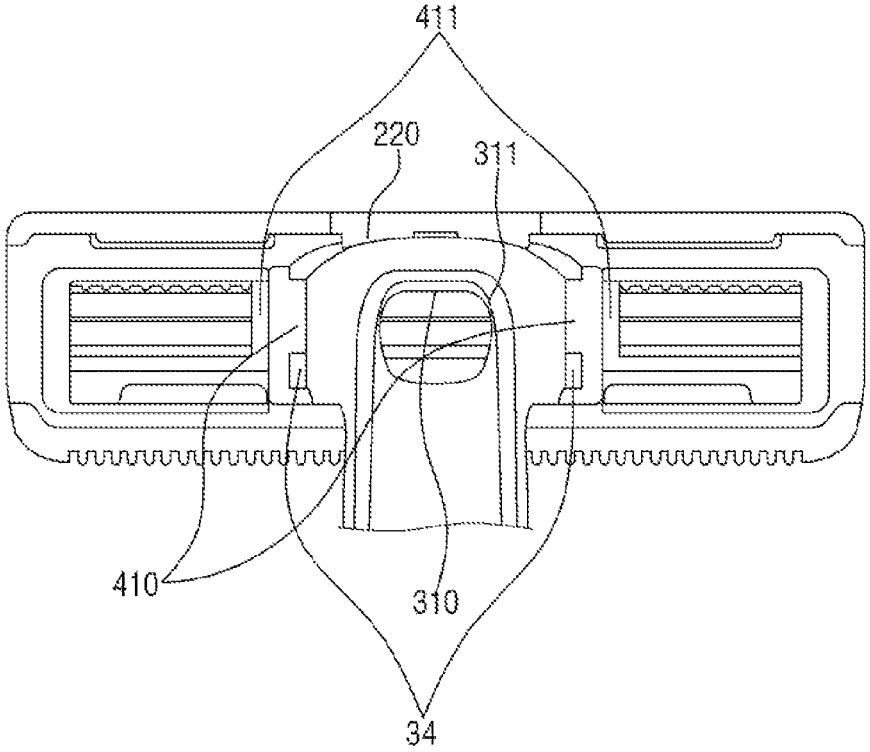
FIG. 8 is a rear view of a razor according to another embodiment of the present disclosure.

FIG. 8 is a rear view of a razor according to another embodiment of the present disclosure.

Referring to FIG. 8, it can be seen that, even after the handle 30 is coupled to the razor blade cartridge 40, a rear surface of the razor blade cartridge 40 that may be observed through the through-hole 31 is not blocked by the seating portion 411. According to another embodiment of the present disclosure, when washing water is injected into the second open area 311 disposed at a rear portion of the razor, the washing water is discharged to the first open area 310 which is disposed adjacent to the razor blade cartridge 40, and since the seating portion 411 is not blocking the rear surface of the razor blade cartridge 40, the central portion of the razor blade 23 may be smoothly washed by the introduced washing water.

In FIG. 5, the seating portion 211 of the razor blade 23 is disposed at both ends and the center of the razor blade cartridge 20 in the long direction of the razor blade cartridge 20 and thus holds the razor blade 23 from three spots.

In FIG. 6, the seating portion 211 of the razor blade 23 is disposed at each position at the front surface of the blade housing 21 corresponding to a position of the first hook 210 and is disposed at both ends of the razor blade cartridge 20 in the long direction of the razor blade cartridge 20 and thus holds the razor blade 23 from four spots. Since the form of arrangement of the seating portions 211 of the other embodiment of FIG. 6 is equivalent to a case in which the seating portions 211, which have been disposed at the center of the blade housing 21, are moved toward both sides, the washing water supplied to the rear surface of the razor blade cartridge 20 through the through-hole 31 may wash the central portion of the razor blade cartridge 20 better.

Those of ordinary skill in the art to which the present disclosure pertains should understand that the present disclosure may be practiced in other specific forms without changing the technical idea or essential features thereof. Therefore, the embodiments described herein are illustrative in all aspects and should not be understood as limiting. The scope of the present disclosure is shown by the claims below rather than the detailed description given above, and all changes or modifications derived from the meaning and the scope of the claims and their equivalents should be interpreted as belonging to the scope of the present disclosure.

Although the present disclosure has been described above in relation to the above-mentioned exemplary embodiments thereof, the present disclosure may be modified or changed in various ways without departing from the gist and scope of the disclosure. Therefore, such modifications or changes belong to the scope of the attached claims as long as the modifications or changes belong to the gist of the present disclosure.

What is claimed is:

1. A razor comprising:

a razor blade cartridge including at least one razor blade; and a handle coupled to a rear of the razor blade cartridge, wherein:

the handle is shaped to comprise a through-hole which extends along at least a portion of a profile of the handle;

the through-hole includes a second opening located at an upper surface of the handle and a third opening located adjacent to an end of a lower surface of the handle; and the second opening and a rear surface of the razor blade cartridge are opposed to each other in a direction toward a front surface from the rear surface of the razor blade cartridge.

2. The razor of claim 1, wherein:

the second opening facilitates entry and discharge of a fluid along a first direction; and the third opening facilitates entry and discharge of the fluid along a second direction different from the first direction.

3. The razor of claim 1, wherein:

a first hook and a second hook are formed at the rear of the razor blade cartridge; and the handle includes a first locking portion configured to be coupled to the first hook and a second locking portion configured to be coupled to the second hook.

4. The razor of claim 3, wherein the razor blade cartridge comprises a seating portion configured to secure the at least one razor blade formed at a position which corresponds to a position of the first hook.

5. The razor of claim 1, wherein a width of the handle increases from a handle portion of the handle toward the end of the handle coupled to the razor blade cartridge.

6. The razor of claim 1, wherein the razor blade cartridge comprises:

a blade housing in which the at least one razor blade is accommodated; and a cartridge frame coupled to the blade housing and configured to secure the at least one razor blade to the blade housing, wherein the blade housing includes a blade housing guard portion which protrudes past a front surface of the cartridge frame.

7. The razor of claim 6, wherein a side surface of the blade housing is externally exposed.

8. The razor of claim 4, wherein the razor blade cartridge further comprises a guard portion disposed below a position of the razor blade at a surface at which the seating portion is disposed.

* * * * *